US009486065B2

(12) United States Patent
Vejar et al.

(10) Patent No.: US 9,486,065 B2
(45) Date of Patent: Nov. 8, 2016

(54) CLEANING ASSEMBLY

(71) Applicants: Mario Vejar, Santa Maria, CA (US); Guillermina Vejar, Santa Maria, CA (US); Jesus Sanchez, Santa Maria, CA (US)

(72) Inventors: Mario Vejar, Santa Maria, CA (US); Guillermina Vejar, Santa Maria, CA (US); Jesus Sanchez, Santa Maria, CA (US)

( * ) Notice: Subject to any disclaimer, the term of this patent is extended or adjusted under 35 U.S.C. 154(b) by 274 days.

(21) Appl. No.: 14/279,639

(22) Filed: May 16, 2014

(65) Prior Publication Data

US 2015/0327744 A1 Nov. 19, 2015

(51) Int. Cl.

| | |
|---|---|
| ***A46B 13/02*** | (2006.01) |
| ***A47L 11/12*** | (2006.01) |
| ***A46B 13/00*** | (2006.01) |
| ***A47L 11/06*** | (2006.01) |
| ***A47L 11/24*** | (2006.01) |
| ***A47L 11/40*** | (2006.01) |

(52) U.S. Cl.

CPC ..... *A46B 13/02* (2013.01); *A46B 13/008* (2013.01); *A46B 13/023* (2013.01); *A47L 11/06* (2013.01); *A47L 11/12* (2013.01); *A47L 11/24* (2013.01); *A47L 11/4038* (2013.01); *A47L 11/4069* (2013.01); *A47L 11/4075* (2013.01)

(58) Field of Classification Search

CPC .. A46B 13/008; A46B 13/02; A46B 13/023; A47L 11/12; A47L 11/4036; A47L 11/4038; A47L 11/4075

USPC ..... 15/22.1, 22.2, 28, 49.1, 52.2, 97.1, 98

See application file for complete search history.

(56) References Cited

U.S. PATENT DOCUMENTS

| | | | | | |
|---|---|---|---|---|---|
| 3,027,585 | A | * | 4/1962 | Freedman | A47J 43/06 15/230.19 |
| 3,231,917 | A | * | 2/1966 | Reed | A47L 11/12 15/22.1 |
| 3,357,033 | A | * | 12/1967 | Sawyer | A47L 11/12 15/98 |
| 3,436,869 | A | * | 4/1969 | Zowe | B24B 23/02 15/28 |
| 3,444,576 | A | * | 5/1969 | Daane | A46B 13/008 15/28 |
| 3,445,877 | A | * | 5/1969 | Stout | A47L 11/12 15/22.1 |
| 4,005,502 | A | * | 2/1977 | Stevens (Boyer) | A46B 13/02 15/22.1 |
| 4,724,567 | A | | 2/1988 | Rones | |
| 5,309,594 | A | | 5/1994 | Thompson | |
| 5,495,632 | A | | 3/1996 | Baker | |
| 5,511,269 | A | | 4/1996 | Watson | |
| 5,797,157 | A | | 8/1998 | Gregg | |
| 5,890,249 | A | * | 4/1999 | Hoffman | A46B 13/02 15/22.1 |
| 5,950,268 | A | | 9/1999 | Murphy et al. | |

(Continued)

FOREIGN PATENT DOCUMENTS

| | | | |
|---|---|---|---|
| DE | 3341465 | * | 5/1985 |
| GB | 811317 | * | 4/1959 |

(Continued)

*Primary Examiner* — Mark Spisich

(57) ABSTRACT

A cleaning assembly cleans and polishes a desired surface by using interchangeable cleaning attachments. The assembly includes a housing having a top wall and a perimeter wall attached to and extending downwardly from the top wall. A plurality of cleaning attachments is provided each having a first surface opposite a second surface. A selectable one of the cleaning attachments is removably coupled to the housing whereby the cleaning attachments are interchangeably couplable to the housing. A motor is electrically coupled to the selectable one of the cleaning attachments when the selectable one of the cleaning attachments is coupled to the housing for vibrating the selectable one of the cleaning attachments.

18 Claims, 6 Drawing Sheets

(56) References Cited

U.S. PATENT DOCUMENTS

| | | | | |
|---|---|---|---|---|
| D498,027 | S | 11/2004 | Alsruh et al. | |
| 7,363,673 | B2 | 4/2008 | Schonewille et al. | |
| 7,565,712 | B2 | 7/2009 | Long et al. | |
| 7,937,792 | B2 | 5/2011 | Munn et al. | |
| 9,038,224 | B1 * | 5/2015 | Esquibel | A46B 13/023 15/22.1 |
| 2004/0103490 | A1 * | 6/2004 | Long | B24B 29/00 15/22.1 |
| 2006/0059640 | A1 * | 3/2006 | Hornsby | A47L 11/12 15/98 |
| 2006/0168746 | A1 * | 8/2006 | Guyuron | A47K 7/04 15/97.1 |
| 2013/0180547 | A1 * | 7/2013 | Kent | A47L 11/282 134/6 |

FOREIGN PATENT DOCUMENTS

| | | | |
|---|---|---|---|
| JP | 2001-70048 | * | 3/2001 |
| JP | 2001-275753 | * | 10/2001 |
| WO | 2013/093619 | * | 6/2013 |

* cited by examiner

CLEANING ASSEMBLY

BACKGROUND OF THE DISCLOSURE

Field of the Disclosure

The disclosure relates to cleaning devices and more particularly pertains to a new cleaning device for cleaning and polishing a desired surface by using interchangeable cleaning attachments.

SUMMARY OF THE DISCLOSURE

An embodiment of the disclosure meets the needs presented above by generally comprising a housing having a top wall and a perimeter wall attached to and extending downwardly from the top wall. A plurality of cleaning attachments is provided each having a first surface opposite a second surface. A selectable one of the cleaning attachments is removably coupled to the housing whereby the cleaning attachments are interchangeably couplable to the housing. A motor is electrically coupled to the selectable one of the cleaning attachments when the selectable one of the cleaning attachments is coupled to the housing for vibrating the selectable one of the cleaning attachments.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
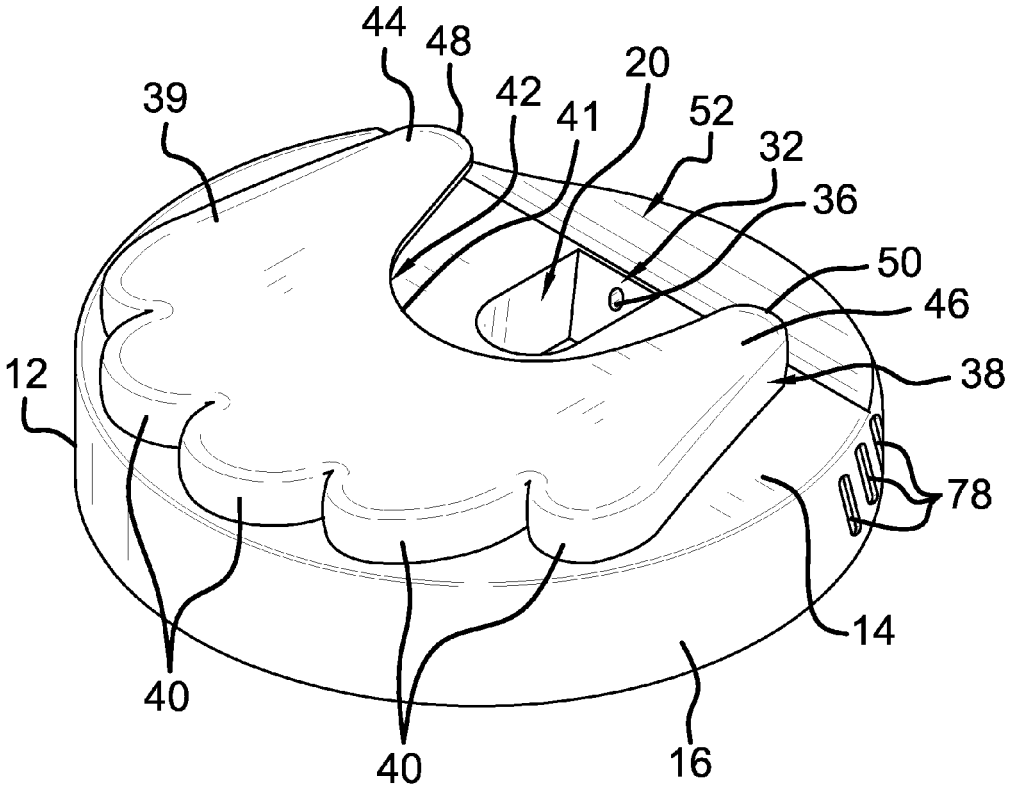
FIG. 1 is a top front side perspective view of a cleaning assembly according to an embodiment of the disclosure.
Figure 2:
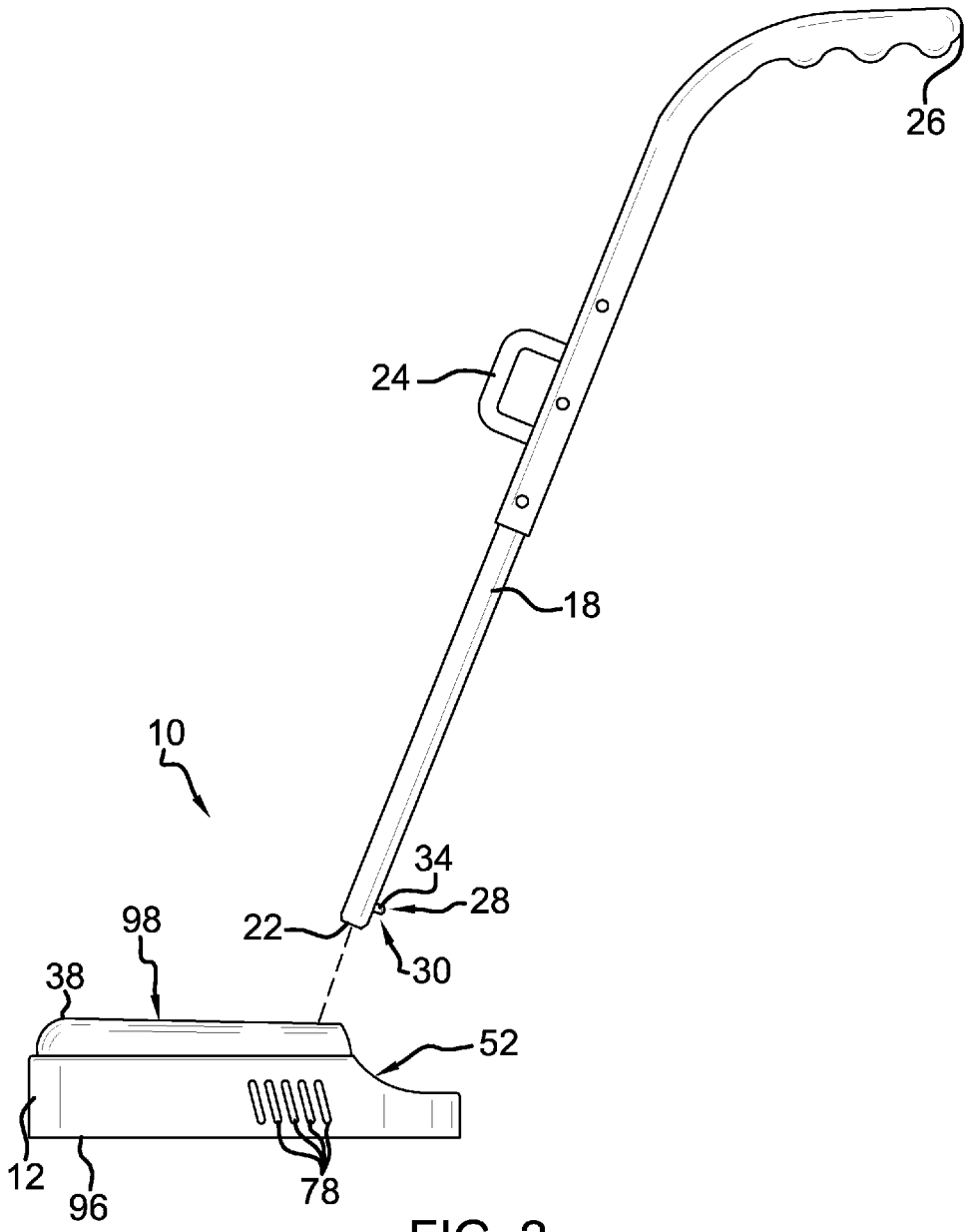
FIG. 2 is a side view of an embodiment of the disclosure.
Figure 3:
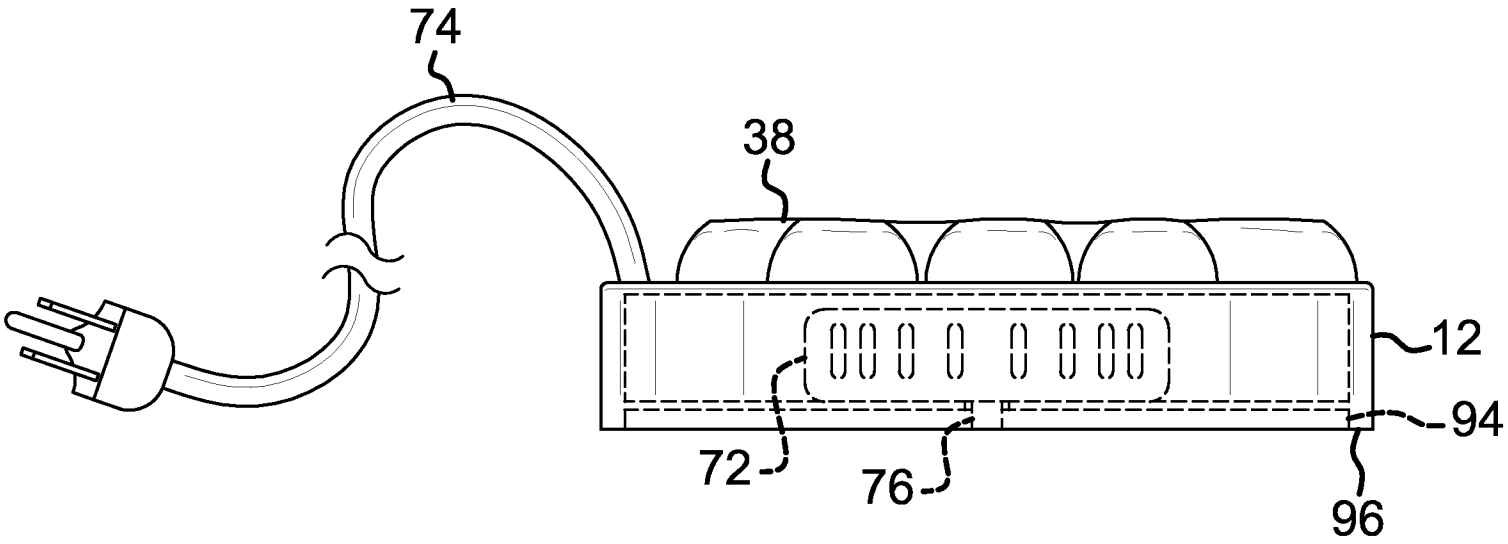
FIG. 3 is a front view of an embodiment of the disclosure.
Figure 4:
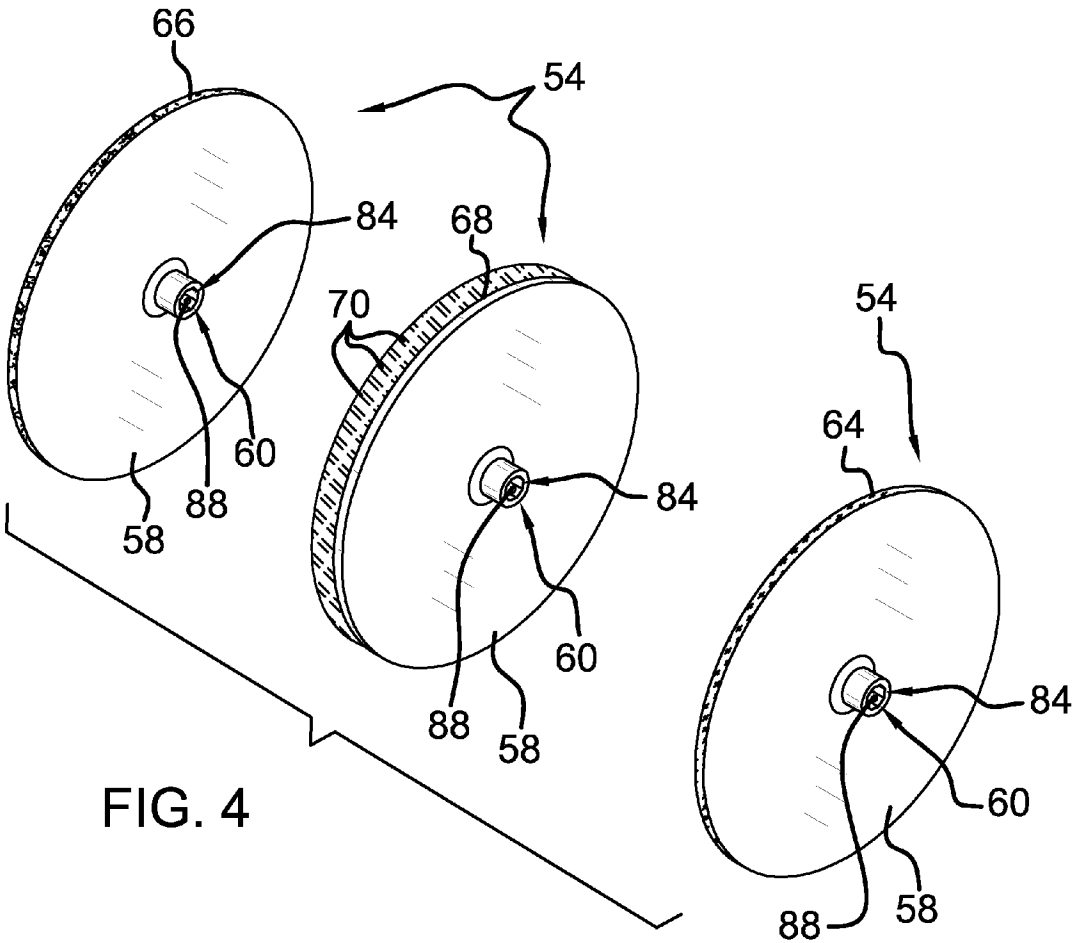
FIG. 4 is a detailed perspective view of a plurality of cleaning attachments of an embodiment of the disclosure.
Figure 5:
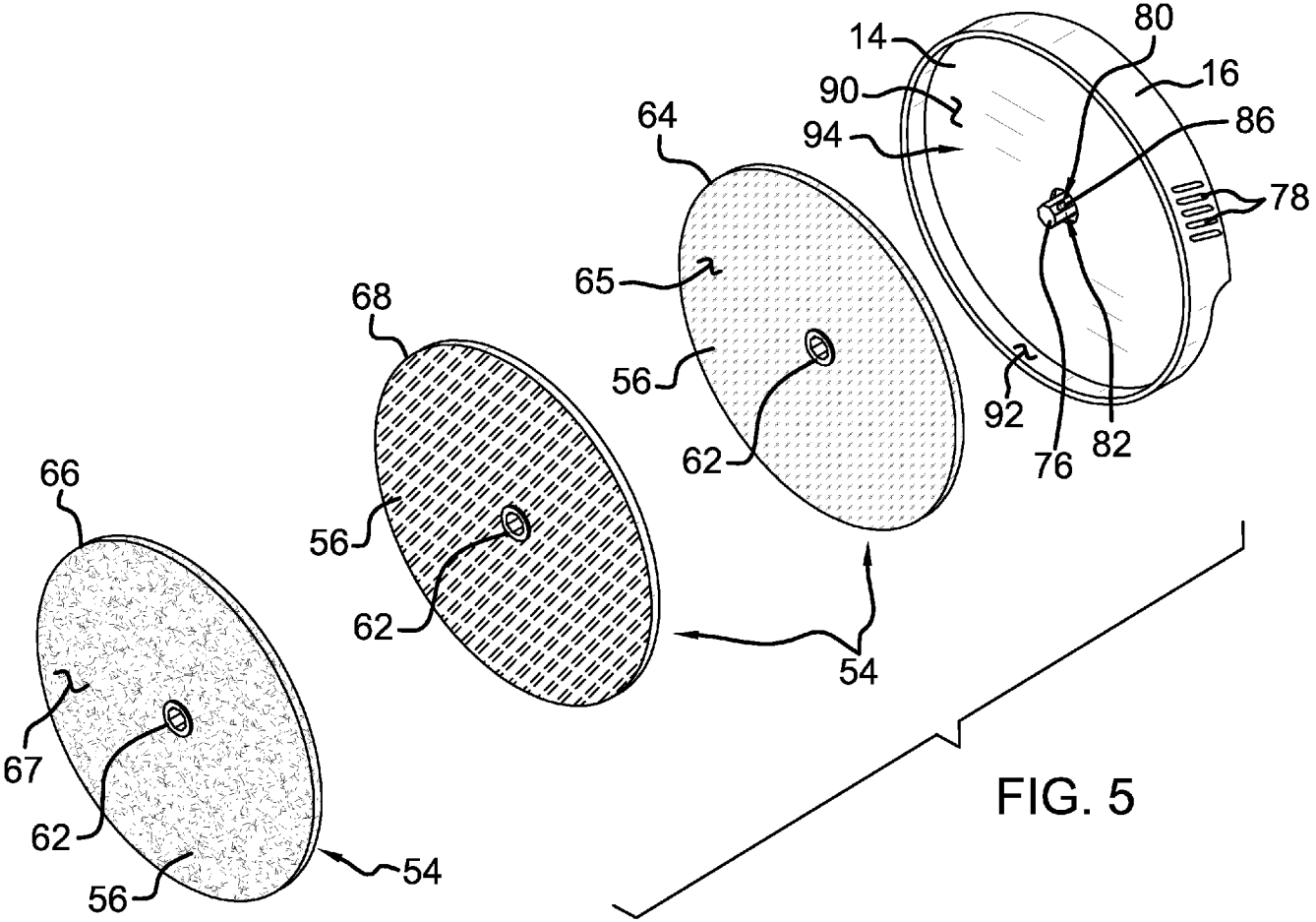
FIG. 5 is a bottom perspective view of an embodiment of the disclosure.
Figure 6:
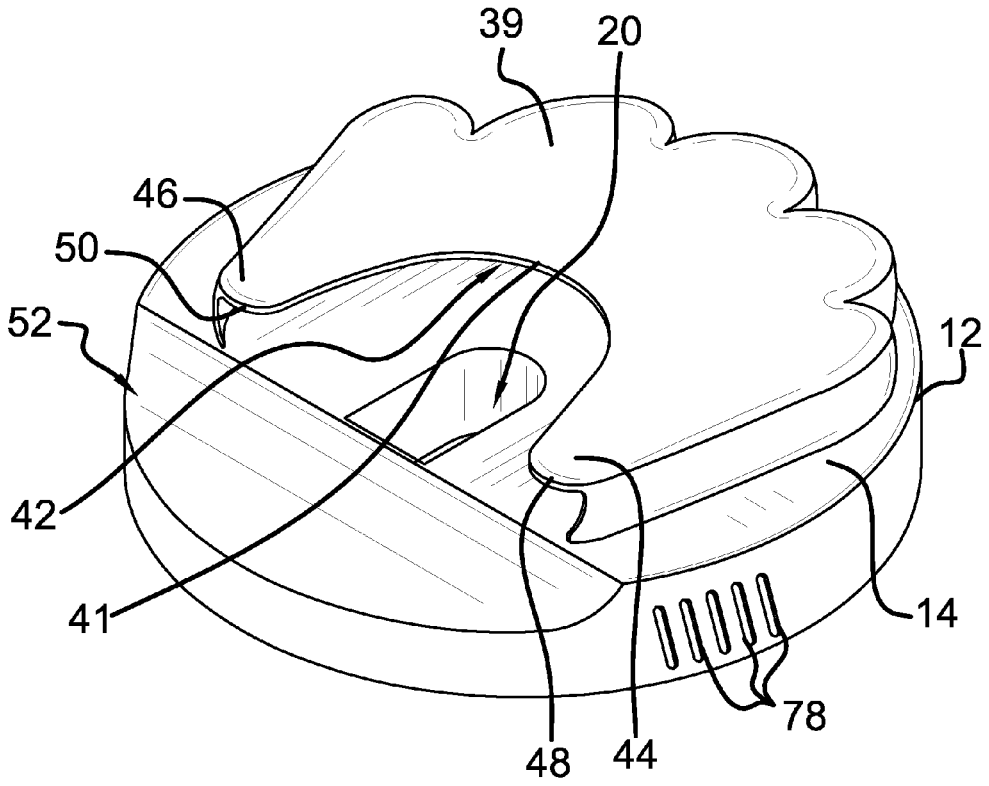
FIG. 6 is a top rear side perspective view of an embodiment of the disclosure.

With reference now to the drawings, and in particular to FIGS. 1 through 6 thereof, a new cleaning device embodying the principles and concepts of an embodiment of the disclosure and generally designated by the reference numeral 10 will be described.

As best illustrated in FIGS. 1 through 6, the cleaning assembly 10 generally comprises a housing 12 having a top wall 14 and a perimeter wall 16 attached to and extending downwardly from the top wall 14. The housing 12 is comprised of a rigid material, such as plastic, metal or the like. An elongated handle 18 is removably coupled to the housing 12. The housing 12 has a port 20 extending therein. A lower end 22 of the handle 18 is insertable into the port 20 for removably coupling the handle 18 to the housing 12. The handle 18 may be telescopic in a generally conventional manner to allow a user to adjust a length of the handle 12. A hand grip 24 is coupled to the handle 12 and may be spaced from an upper end 26 of the handle 18. A securing assembly 28 removably secures the lower end 22 of the handle 18 to the housing 12. The securing assembly 28 includes a first securing member 30 coupled to the handle 18 proximate the lower end 22 of the handle 18 and a second securing member 32 positioned in the port 20. The first securing member 30 may include a locking pin 34 and the second securing member 32 may include an aperture 36 wherein the aperture 36 receives the locking pin 34 therein.

A hand mitt 38 is coupled to the top wall 14. The hand mitt 38 has a main body 39 and a plurality of finger projections 40 attached to the main body 39. Each of the finger projections 40 is configured to receive a finger of a user therein. The main body 39 has a first end 41 being open wherein the user's fingers are received in the main body 39 through the first end 41. The hand mitt 38 permits a user to use the assembly 10 without the handle 18 wherein the user's hand, when positioned in the hand mitt 38, maneuvers the housing 12 where desired. The hand mitt 38 may have a notch 42 extending therein toward the finger projections 40 defining a pair of spaced arms 44, 46. The notch 42 ensures that the hand mitt 38 does not obstruct the port 20. Each of the arms 44, 46 has a distal end 48, 50 with respect to the finger projections 40. The top wall 14 of the housing 12 may curve downwardly from the distal ends 48, 50 of the arms 44, 46 to the perimeter wall 16 of the housing 12 defining a ramp 52 configured for supporting a palm of the user's hand when the user's fingers are positioned in the hand mitt 38. The hand mitt 38 may comprise a flexible material. A distance from a top 98 of the hand mitt 38 to a bottom edge 96 of the perimeter wall 16 of the housing 12 may measure between approximately 18.0 cm and 32.0 cm. An outer diameter of the housing 12 may also measure between approximately 18.0 cm and 32.0 cm.

A plurality of cleaning attachments 54 is provided each having a first surface 56 opposite a second surface 58. A selectable one of the cleaning attachments 54 is removably coupled to the housing 12 whereby the cleaning attachments 54 are interchangeably couplable to the housing 12 in order to accomplish a variety of cleaning tasks. Each of the cleaning attachments 54 has a socket 60 coupled to a respective one of the second surfaces 58. The first surface 56 of each cleaning attachment 54 has a respective hole 62 positioned therein. Each hole 62 extends around the respective socket 60. The plurality of cleaning attachments 54 may include a pad attachment 64, a bonnet attachment 66 and a brush attachment 68. The first surface 56 of the pad attachment 64 is comprised of an abrasive material 65, while the first surface 56 of the bonnet attachment 66 is comprised of a non-abrasive material 67, such as terry cloth, microfiber or the like. The non-abrasive material 67 is used for applying or buffing away polish, wax or a similar substance. The first surface 56 of the brush attachment 68 has a plurality of bristles 70 extending outwardly therefrom.

A motor 72 is electrically coupled to the selectable one of the cleaning attachments 54 when the selectable one of the cleaning attachments 54 is coupled to the housing for vibrating the selectable one of the cleaning attachments. A power source 74 is electrically coupled to the motor 72 for causing vibrational movement of the selectable one of the cleaning attachments 54 when the selectable one of the cleaning attachments 54 is coupled to the housing 12. The power source 74 may include at least one rechargeable battery or a power cord electrically couplable to an external electrical outlet. A shaft 76 is operationally coupled to and extends from the motor 72. The shaft 76 is coupled to the housing 12 and is insertable into the socket 60 of the selectable one of the cleaning attachments 54 for removably coupling the selectable one of the cleaning attachments 54 to the motor 72. The hole 62 of the selectable one of the cleaning attachments 54 receives the shaft 76 when the selectable one of the cleaning attachments 54 is attached to the housing 12. The housing 12 may have at least one vent 78 positioned therein whereby an interior space of the housing 12 is in fluid communication with ambient space surrounding each vent 78. This will provide airflow to the motor 72 in order to help prevent the motor 72 from overheating during use of the assembly 10.

A locking assembly 80 is provided including a first mating member 82 coupled to the shaft 76 and a plurality of second mating members 84 each coupled to a respective one of the sockets 60. The locking assembly 80 removably secures the shaft 76 to the selectable one of the cleaning attachments 54 when the shaft 76 is received within the respective socket 60. The first mating member 82 may include a spring-loaded ball 86 and each second mating member 84 may include a detent member 88. Each detent member 88 receives the associated ball 86 therein in a generally conventional manner when the shaft 76 is received within the respective socket 60.

A bottom surface 90 of the top wall 14 and an inner surface 92 of the perimeter wall 16 define a receiving space 94 for receiving the selectable one of the cleaning attachments 54. The shaft 76 extends from the bottom surface 90 of the top wall 14. The first surface 56 of each cleaning attachment 54 may be positioned flush with the bottom edge 96 of the perimeter wall 16 of the housing 12 when the selectable one of the cleaning attachments 54 is positioned in the receiving space 94.

In use, a selectable one of the cleaning attachments 54 is attached to the housing 12 depending on the particular cleaning task that needs to be accomplished. Thus, the pad attachment 64 and the brush attachment 68 can be used to clean floors, sinks toilets or the like, while the bonnet attachment 66 can be used to polish a floor, car or other desired surface. The user then grasps the handle 18 and rubs the cleaning attachment 54 against the surface to be cleaned. Alternatively, the user can remove the handle 18 and position his or her hand inside the hand mitt 38 to guide the cleaning attachment 54 over the surface to be cleaned.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A cleaning assembly comprising:

a housing having a top wall and a perimeter wall attached to and extending downwardly from said top wall;

a plurality of cleaning attachments each having a first surface opposite a second surface, a selectable one of said cleaning attachments being removably coupled to said housing whereby said cleaning attachments are interchangeably couplable to said housing;

a motor electrically coupled to said selectable one of said cleaning attachments when said selectable one of said cleaning attachments is coupled to said housing for vibrating said selectable one of said cleaning attachments;

a hand mitt coupled to said top wall, said hand mitt having a main body and a plurality of finger projections attached to said main body, each of said finger projections being configured to receive a finger of a user therein, said main body having a first end being open wherein the user's fingers are received in said body through said first end, said hand mitt having a notch extending therein toward said finger projections defining a pair of spaced arms, each of said arms having a distal end with respect to said finger projections; and said top wall curving downwardly from said distal ends of said arms to said perimeter wall of said housing defining a ramp configured for supporting a palm of the user's hand when the user's fingers are positioned in said hand mitt.

2. The assembly of claim 1, further comprising:

a shaft operationally coupled to and extending from said motor, said shaft being coupled to said housing: and each of said cleaning attachments having a respective socket coupled thereto, said shaft being insertable into said socket of said selectable one of said cleaning attachments for removably coupling said selectable one of said cleaning attachments to said motor.

3. The assembly of claim 2, further comprising a locking assembly including a first mating member coupled to said shaft and a plurality of second mating members, each of said second mating members being coupled to a respective one of said sockets, said locking assembly removably securing said shaft to said selectable one of said cleaning attachments when said shaft is received within said respective socket.

4. The assembly of claim 3, further comprising wherein said first mating member includes a ball and each said second mating member includes a detent member, each said detent member receiving said associated ball therein when said shaft is received within said respective socket.

5. The assembly of claim 2, further comprising wherein a bottom surface of said top wall and an inner surface of said perimeter wall define a receiving space for receiving said selectable one of said cleaning attachments, said shaft extending from said bottom surface of said top wall.

6. The assembly of claim 5, further comprising said first surface of each said cleaning attachment being positioned flush with a bottom edge of said perimeter wall of said housing when said selectable one of said cleaning attachments is positioned in said receiving space.

7. The assembly of claim 2, further comprising said first surface of each said cleaning attachment having a respective hole positioned therein, each said hole extending around said respective socket, said hole of said selectable one of said cleaning attachments receiving said shaft when said selectable one of said cleaning attachments is attached to said housing.

8. The assembly of claim 1, further comprising an elongated handle coupled to said housing.

9. The assembly of claim 8, further comprising said handle being removably coupled to said housing.

10. The assembly of claim 9, further comprising said housing having a port extending therein, a lower end of said handle being insertable into said port for removably coupling said handle to said housing.

11. The assembly of claim 10, further comprising a securing assembly removably securing said lower end of said handle to said housing, said securing assembly including a first securing member coupled to said handle proximate said lower end of said handle and a second securing member positioned in said port.

12. The assembly of claim 8, further comprising said handle being telescopic.

13. The assembly of claim 8, further comprising a hand grip coupled to said handle, said hand grip being spaced from an upper end of said handle.

14. The assembly of claim 1, further comprising said housing having at least one vent positioned therein whereby an interior space of said housing is in fluid communication with ambient space surrounding each said vent.

15. The assembly of claim 1, further comprising wherein said plurality of cleaning attachments includes a pad attachment, said first surface of said pad attachment being comprised of an abrasive material.

16. The assembly of claim 1, further comprising wherein said plurality of cleaning attachments includes a bonnet attachment, said first surface of said bonnet attachment being comprised of a non-abrasive material.

17. The assembly of claim 1, further comprising wherein said plurality of cleaning attachments includes a brush attachment, said first surface of said brush attachment having a plurality of bristles extending outwardly therefrom.

18. A cleaning assembly comprising:

a housing having a top wall and a perimeter wall attached to and extending downwardly from said top wall, said housing having a port extending therein, said housing having at least one vent positioned therein whereby an interior space of said housing is in fluid communication with ambient space surrounding each said vent;

an elongated handle removably coupled to said housing, a lower end of said handle being insertable into said port for removably coupling said handle to said housing, said handle being telescopic;

a hand grip coupled to said handle, said hand grip being spaced from an upper end of said handle;

a securing assembly removably securing said lower end of said handle to said housing, said securing assembly including a first securing member coupled to said handle proximate said lower end of said handle and a second securing member positioned in said port, said first securing member including a locking pin and said second securing member including an aperture, said aperture receiving said locking pin therein;

a hand mitt coupled to said top wall, said hand mitt having a main body and a plurality of finger projections attached to said main body, each of said finger projections being configured to receive a finger of a user therein, said main body having a first end being open wherein the user's fingers are received in said body through said first end, said hand mitt having a notch extending therein toward said finger projections defining a pair of spaced arms, each of said arms having a distal end with respect to said finger projections, said top wall of said housing curving downwardly from said distal ends of said arms to said perimeter wall of said housing defining a ramp configured for supporting a palm of the user's hand when the user's fingers are positioned on said hand mitt;

a plurality of cleaning attachments each having a first surface opposite a second surface, a selectable one of said cleaning attachments being removably coupled to said housing whereby said cleaning attachments are interchangeably couplable to said housing, each of said cleaning attachments having a respective socket coupled thereto, said first surface of each said cleaning attachment having a respective hole positioned therein, each said hole extending around said respective socket, said plurality of cleaning attachments including;

a pad attachment, said first surface of said pad attachment being comprised of an abrasive material;

a bonnet attachment, said first surface of said bonnet attachment being comprised of a non-abrasive material; and a brush attachment, said first surface of said brush attachment having a plurality of bristles extending outwardly therefrom;

a motor electrically coupled to said selectable one of said cleaning attachments when said selectable one of said cleaning attachments is coupled to said housing for vibrating said selectable one of said cleaning attachments;

a power source electrically coupled to said motor for causing vibrational movement of said selectable one of said cleaning attachments when said selectable one of said cleaning attachments is coupled to said housing;

a shaft operationally coupled to and extending from said motor, said shaft being coupled to said housing, said shaft being insertable into said socket of said selectable one of said cleaning attachments for removably coupling said selectable one of said cleaning attachments to said motor, said hole of said selectable one of said cleaning attachments receiving said shaft when said selectable one of said cleaning attachments is attached to said housing;

a locking assembly including a first mating member coupled to said shaft and a plurality of second mating members, each of said second mating members being coupled to a respective one of said sockets, said locking assembly removably securing said shaft to said selectable one of said cleaning attachments when said shaft is received within said respective socket, said first mating member including a ball and each said second mating member including a detent member, each said detent member receiving said associated ball therein when said shaft is received within said respective socket; and a bottom surface of said top wall and an inner surface of said perimeter wall define a receiving space for receiving said selectable one of said cleaning attachments, said shaft extending from said bottom surface of said top wall, said first surface of each said cleaning attachment being positioned flush with a bottom edge of said perimeter wall of said housing when said selectable one of said cleaning attachments is positioned in said receiving space.

* * * * *